US008556365B2

(12) United States Patent
Koike et al.

(10) Patent No.: US 8,556,365 B2
(45) Date of Patent: Oct. 15, 2013

(54) LIQUID EJECTING APPARATUS

(75) Inventors: Yasunori Koike, Matsumoto (JP); Yoichi Yamada, Shiojiri (JP); Narihiro Oki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 177 days.

(21) Appl. No.: 13/028,080

(22) Filed: Feb. 15, 2011

(65) Prior Publication Data

US 2011/0199411 A1 Aug. 18, 2011

(30) Foreign Application Priority Data

Feb. 16, 2010 (JP) ..... 2010-031700

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS 7,771,038 B2 8/2010 Araya et al.

FOREIGN PATENT DOCUMENTS

CN 1703318 A 11/2005
JP 2003-220695 A 8/2003

*Primary Examiner* — Stephen Meier
*Assistant Examiner* — Tracey McMillion
(74) *Attorney, Agent, or Firm* — Kilpatrick Townsend & Stockton LLP

(57) ABSTRACT

A liquid ejecting apparatus includes: a transport unit that transports a recording medium; a liquid ejecting head that ejects a liquid onto the recording medium; a carriage that holds the liquid ejecting head; a charge amount detection unit that detects a charge amount on the recording medium; and a driving control unit. In the case where the charge amount detected by the charge amount detection unit has exceeded a predetermined value, the driving control unit performs at least one of the following: controls the transport unit so that the transport speed of the recording medium becomes relatively slower.

8 Claims, 7 Drawing Sheets

LIQUID EJECTING APPARATUS

BACKGROUND

1. Technical Field

The present invention relates to liquid ejecting apparatuses.

2. Related Art

Ink jet recording apparatuses that, for example, record text, images, or the like onto a recording medium are known as liquid ejecting apparatuses that eject a liquid. Ink jet recording apparatuses are configured so as to record onto a recording medium by ejecting ink onto the recording medium from nozzles provided in an ejection head while transporting the recording medium.

Incidentally, there are cases where the nozzle surface of the ejection head makes contact with the recording medium during transport. At this time, there is a risk that the nozzle surface will become charged by rubbing upon the recording medium. Meanwhile, recording paper, which is typically used as the recording medium, has foreign objects such as paper dust and so on that, while small, nevertheless cling to the surface of the paper. Thus in this case, there is a risk that ejecting problems will arise due to such foreign objects sticking to the charged nozzle surface.

As a response to this problem, techniques for removing foreign objects by rubbing the surface of the recording paper that is below the nozzle surface during transport with a discharging pin member (see, for example, JP-A-2003-220695).

However, with the technique disclosed in JP-A-2003-220695, paper dust is produced with ease due to the contact between a discharging brush and the paper surface, which can lead to ejection problems caused by the paper dust sticking to the nozzle surface as foreign objects; thus this technique is unreliable.

SUMMARY

An advantage of some aspects of the invention is to provide a liquid ejecting apparatus capable of highly-reliable liquid ejection by preventing foreign objects such as paper dust from sticking to a nozzle surface.

A liquid ejecting apparatus according to an aspect of the invention includes: a transport unit that transports a recording medium; a liquid ejecting head that ejects a liquid from a nozzle onto the recording medium transported by the transport unit; a carriage that holds the liquid ejecting head so that the liquid ejecting head can move back and forth along a guide portion; a charge amount detection unit that detects a charge amount on the recording medium; and a driving control unit. In the case where the charge amount detected by the charge amount detection unit has exceeded a predetermined value, the driving control unit performs at least one of the following: controls the transport unit so that the transport speed of the recording medium becomes relatively slower; causes the carriage to move back and forth along the guide portion so that the liquid ejecting head begins to return at a position in which a nozzle does not overlap with the end surface of the recording medium when viewed from above; and drives a discharging mechanism that discharges a contact portion of the transport unit that comes into contact with the recording medium.

When the charge amount of the recording medium exceeds a predetermined value, foreign objects that stick to the surface of the recording medium carry a high charge, and there is thus a risk that the foreign objects will stick to the nozzle of the liquid ejecting head due to the effects of Coulomb force. Accordingly, by employing this invention, the charge amount of the recording medium is reduced by reducing the transport speed of the recording medium when the charge amount of the recording medium has exceeded the predetermined value; this makes it possible to prevent the foreign objects from sticking to the peripheral areas of the nozzle. Furthermore, according to the invention, when the charge amount of the recording medium has exceeded the predetermined value, the carriage is moved back and forth so that the liquid ejecting head starts to return at a position in which the end surface of the recording medium, where a high amount of foreign objects stick to the recording medium, does not overlap with the nozzle; this makes it possible to prevent the foreign objects from sticking to the nozzle. Further still, according to the invention, when the charge amount of the recording medium has exceeded the predetermined value, the charge amount of the recording medium itself can be reduced by discharging a contact portion that makes contact with the recording medium.

Accordingly, the liquid ejecting apparatus prevents the occurrence of liquid ejection problems caused by foreign objects sticking to the nozzle surface, and thus the apparatus is a highly-reliable apparatus capable of ejecting liquid from the nozzle with precision.

In a liquid ejecting apparatus according to another aspect of the invention, in the case where the carriage is moved back and forth along the guide portion, it is preferable for the driving control unit to cause the liquid ejecting head to return at a position in which the liquid ejecting head does not overlap with the recording medium when viewed from above.

According to this configuration, the nozzle surface of the liquid ejecting head is disposed in a position that does not overlap with the end surface of the recording medium, where a high amount of foreign objects stick to the recording medium, when viewed from above; this makes it possible to prevent the foreign objects from sticking to the nozzle with more certainty.

In a liquid ejecting apparatus according to another aspect of the invention, it is preferable for the liquid ejecting head to include a nozzle surface having multiple nozzle rows in which multiple nozzles are arranged, and in the case where the carriage is moved back and forth along the guide portion, for the driving control unit to cause the liquid ejecting head to return when the end surface of the recording medium is positioned between the multiple nozzle rows when viewed from above.

According to this configuration, in the case where the carriage is caused to move back and forth a position in which the liquid ejecting head and the recording medium overlap when viewed from above, the end surface of the recording medium, where a high amount of foreign objects stick to the recording medium, and the nozzle do not overlap when viewed from above, which makes it possible to prevent the foreign objects from sticking to the nozzle with certainty.

In a liquid ejecting apparatus according to another aspect of the invention, it is preferable for the discharging mechanism to have a grounding structure that grounds the contact portion.

According to this configuration, the contact portion is grounded, which makes it possible to discharge the recording medium itself when the recording medium makes contact with the contact portion; this in turn makes it possible to reduce the charge amount of the recording medium.

In a liquid ejecting apparatus according to another aspect of the invention, it is preferable for the discharging mechanism to include a grounding brush that is grounded and a driving unit that causes the grounding brush to come into contact with or retract from the contact portion.

According to this configuration, the recording medium can be discharged by bringing the grounding brush into contact with the contact portion, which in turn makes it possible to reduce the charge amount of the recording medium.

In a liquid ejecting apparatus according to another aspect of the invention, it is preferable for the driving control unit to control the transport unit, the carriage, and the discharging mechanism in progressive stages in accordance with the degree of the charge amount detected by the charge amount detection unit.

According to this configuration, the optimal process among the aforementioned processes can be carried out in accordance with the degree of the charge amount. Accordingly, the charge amount of the recording medium can be reduced efficiently without waste.

In a liquid ejecting apparatus according to another aspect of the invention, it is preferable for the recording medium to be paper.

When paper is used as the recording medium, it is difficult to avoid producing paper dust. However, according to the invention, it is possible to prevent charged paper dust from sticking to the nozzle surface as a foreign object by reducing the charge amount of the recording medium. Accordingly, it is possible to prevent liquid ejection problems caused by paper dust.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
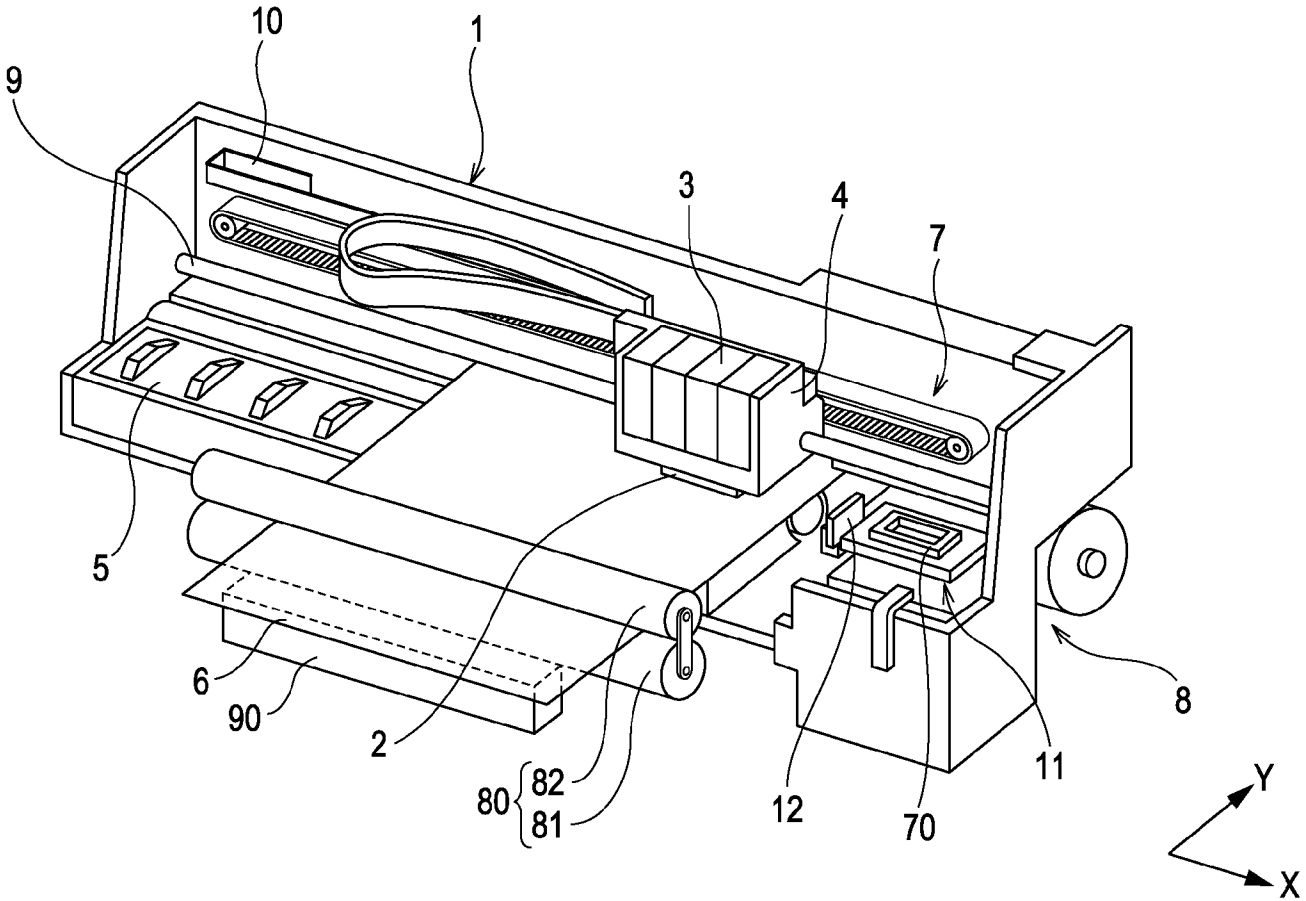
FIG. 1 is an external perspective view illustrating a printer.

An exemplary embodiment of a liquid ejecting apparatus according to the invention will now be described. It should be noted that the embodiment is a specific description intended to facilitate understanding of the essential spirit of the invention, and is thus not intended to limit the invention in any particular way unless otherwise indicated. Furthermore, in the drawings used to in the following descriptions, there are cases where primary elements are illustrated in an enlarged state in order to facilitate understanding of the characteristics of the invention, and thus the dimension ratios and so on of the constituent elements are not necessarily the same as the actual dimensions thereof.

The following describes an ink jet printer (called simply a "printer" hereinafter) as an exemplary embodiment of a liquid ejecting apparatus according to the invention.

FIG. 1 is an external perspective view illustrating a printer (liquid ejecting apparatus) according to the invention. A printer (liquid ejecting apparatus) 1 includes a carriage 4 that holds a recording head (liquid ejection head) 2 serving as a type of liquid ejection head and an ink cartridge 3. The ink cartridge 3 holds the ink (liquid) to be ejected from the recording head 2, and may be attached to the carriage 4 in a removable state.

The printer (liquid ejecting apparatus) 1 also includes a platen 5, disposed below the recording head 2, for transporting recording paper (a recording medium) 6, a carriage movement mechanism 7 that moves the carriage 4 along the paper width direction of the recording paper 6, and a paper feed mechanism (transport unit) 8 that transports the recording paper 6 in a paper feed direction. Note that the "paper width direction" mentioned here refers to the main scanning direction (the head scanning direction, or the X axis in FIG. 1). Likewise, the "paper feed direction" mentioned here refers to the sub scanning direction (the direction orthogonal to the main scanning direction, or the Y axis in FIG. 1).

The printer 1 according to this embodiment supplies, for example, magenta, yellow, and cyan inks to the recording head 2 from the ink cartridge 3. Other inks, such as, for example, white, black, or the like, may also be provided.

In addition to the configuration in which the ink cartridge 3 is attached to the carriage 4, as in this embodiment, other configurations are possible; for example, ink may be supplied to the recording head 2 via an ink supply tube mounted in the main body of the printer 1.

The carriage 4 is attached to a guide rod (a guide portion) 9 in a freely-movable state. The guide rod 9 is a support member that extends along the main scanning direction X. The carriage 4 is moved in the main scanning direction X along the guide rod 9 by the carriage movement mechanism 7.

The printer 1 is also provided with a linear encoder 10. The linear encoder 10 detects the position of the carriage 4 in the main scanning direction X. A signal resulting from the detection is sent to a controller (not shown) as position information. A control unit (driving control unit) 58, which will be mentioned later, recognizes the scanning position of the recording head 2 based on the position information detected by the linear encoder 10 and controls recording operations (ejection operations) and so on performed by the recording head 2.

Of the range of movement of the recording head 2 along the main scanning direction X, a region outside of the platen 5 is set as a home position, which serves as the starting point for scanning of the recording head 2. A capping mechanism 11 is provided at the home position. The capping mechanism 11 seals a nozzle opening formation surface of the recording head 2 using a cap 70, thus preventing the ink carrier from evaporating. The capping mechanism 11 is used in cleaning operations and the like, where negative pressure is applied to the nozzle surface of the recording head 2 while in a sealed state and ink is forcefully drawn in and discharged.

A wiper portion 12 that wipes the ejection surface in which the nozzles of the recording head 2 are formed is provided adjacent to the capping mechanism 11. The wiper portion 12 can wipe ink that sticks to the periphery of the nozzle openings by the wiper portion 12 sliding along the entire ejection surface of the recording head 2 when the recording head 2 moves in the main scanning direction X, from the region in which the platen 5 is locates toward the capping mechanism 11. The wiper portion 12 is configured of a flexible member such as an elastomer or the like.

Figure 2:
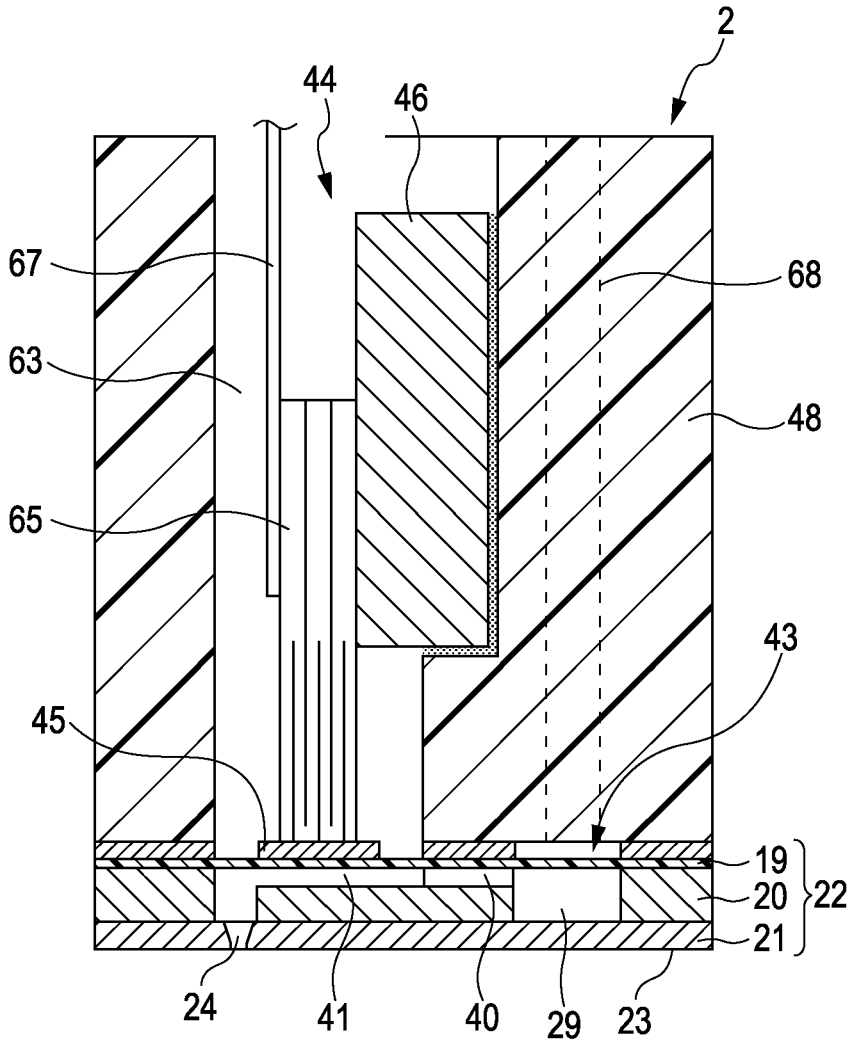
FIG. 2 is a cross-sectional view illustrating the principal constituent elements of a recording head.

FIG. 2 is a cross-sectional view illustrating the principal constituent elements of the recording head (liquid ejection head).

The recording head 2 includes a main head body 48 and a flow channel formation unit 42 that has a vibrating plate 19, a flow channel substrate 20, and a nozzle substrate 21. Nozzles 24 are formed in the nozzle substrate 21.

The flow channel formation unit 42 is configured as a single entity by stacking the vibrating plate 19, the flow channel substrate 20, and the nozzle substrate 21, and affixing these elements to each other using an adhesive or the like. Furthermore, the recording head 2 may be a so-called line head, in which multiple nozzles 24 are arranged across a length that is greater than or equal to the width of the recording paper (recording medium) of the maximum size that can be handled by the printer 1 (that is, the maximum recording paper width).

The recording head 2 includes a housing space 63 formed within the main head body 48 and a driving unit 44 disposed within the housing space 63. The driving unit 44, meanwhile, includes multiple piezoelectric elements 65, an anchor member 46 that supports the upper ends of the piezoelectric elements 65, and a flexible cable 67 that supplies driving signals to the piezoelectric elements 65. Each of the piezoelectric elements 65 is provided for a corresponding nozzle 24.

The recording head 2 further includes: an internal flow channel 68, formed within the main head body 48, through which ink (liquid) supplied from an ink cartridge via an ink supply tube flows; a common ink chamber 29, formed by the flow channel formation unit 22 that includes the vibrating plate 19, the flow channel substrate 20, and the nozzle substrate 21, that is connected to the internal flow channel 68; an ink supply opening 40, formed by the flow channel formation unit 22, that is connected to the common ink chamber 29; and a pressure chamber 41, formed by the flow channel formation unit 22, that is connected to the ink supply opening 40. Multiple pressure chambers 41 are provided in correspondence to the multiple nozzles 24. The multiple nozzles 24 are connected to respective pressure chambers 41.

The main head body 48 may be formed of, for example, a synthetic resin. The vibrating plate 19 may be a plate in which an elastic film has been laminated to the surface of a support plate made of a metal such as stainless steel. Island portions 45 that are respectively affixed to the lower end of the piezoelectric elements 65 are formed in areas of the vibrating plate 19 corresponding to the pressure chambers 41. At least part of the vibrating plate 19 undergoes elastic deformation in response to the driving of the piezoelectric elements 65. A compliance portion 43 is formed between the vibrating plate 19 and the vicinity of the lower end of the internal flow channel 68.

The flow channel substrate 20 includes concave portions for forming the spaces serving as the common ink chamber 29, the ink supply opening 40, and the pressure chambers 41 that connect the lower end of the internal flow channel 68 to the nozzles 24. The flow channel substrate 20 is obtained by, for example, carrying out anisotropic etching on silicon.

The nozzle substrate 21 has multiple nozzles 24 formed at predetermined intervals (pitch) in a predetermined direction. The nozzle substrate 21 according to this embodiment is a plate-shaped member formed of a metal such as stainless steel. The bottom surface of the nozzle substrate 21 configures an ejection surface (nozzle surface) 23 in which the opening ends of the multiple nozzles 24 are exposed, as will be described later. The multiple nozzles 24 are disposed so as to be grouped in clusters of a predetermined number. For example, in this embodiment, the nozzles 24 are formed in groups of a predetermined number, as nozzle rows A, B, and C (see FIG. 6B). The nozzle rows A, B, and C eject magenta, yellow, and cyan inks, respectively.

The printer 1 configured in this manner includes an ink cartridge (not shown) that serves as an ink holding unit (liquid holding unit) that holds ink, and is configured so that ink supplied from the ink cartridge via the ink supply tube flows into the upper end of the internal flow channel 68 illustrated in FIG. 2. The lower end of the internal flow channel 68 is connected to the common ink chamber 29, and the ink that has flowed into the upper end of the internal flow channel 68 from the ink cartridge via the ink supply tube (not shown) is supplied to the common ink chamber 29 after having flowed through the internal flow channel 68. The ink supplied to the common ink chamber 29 is then distributed to the respective multiple pressure chambers 41 via the ink supply opening 40.

The piezoelectric elements 65 extend and contract when driving signals are inputted into the piezoelectric elements 65 via the cable 67. The vibrating plate 19 then deforms (moves) in the directions toward and away from the pressure chamber 41. As a result, the volume of the pressure chamber 41 changes, resulting in a fluctuation in the pressure of the pressure chamber 41 that holds the ink. Ink is ejected (discharged) from the nozzles 24 due to this pressure fluctuation. In this manner, the piezoelectric elements 65 cause the pressure within the pressure chambers 41 connected to the nozzles 24 to fluctuate based on the inputted driving signals, in order to eject ink from the nozzles 24.

Figure 3:
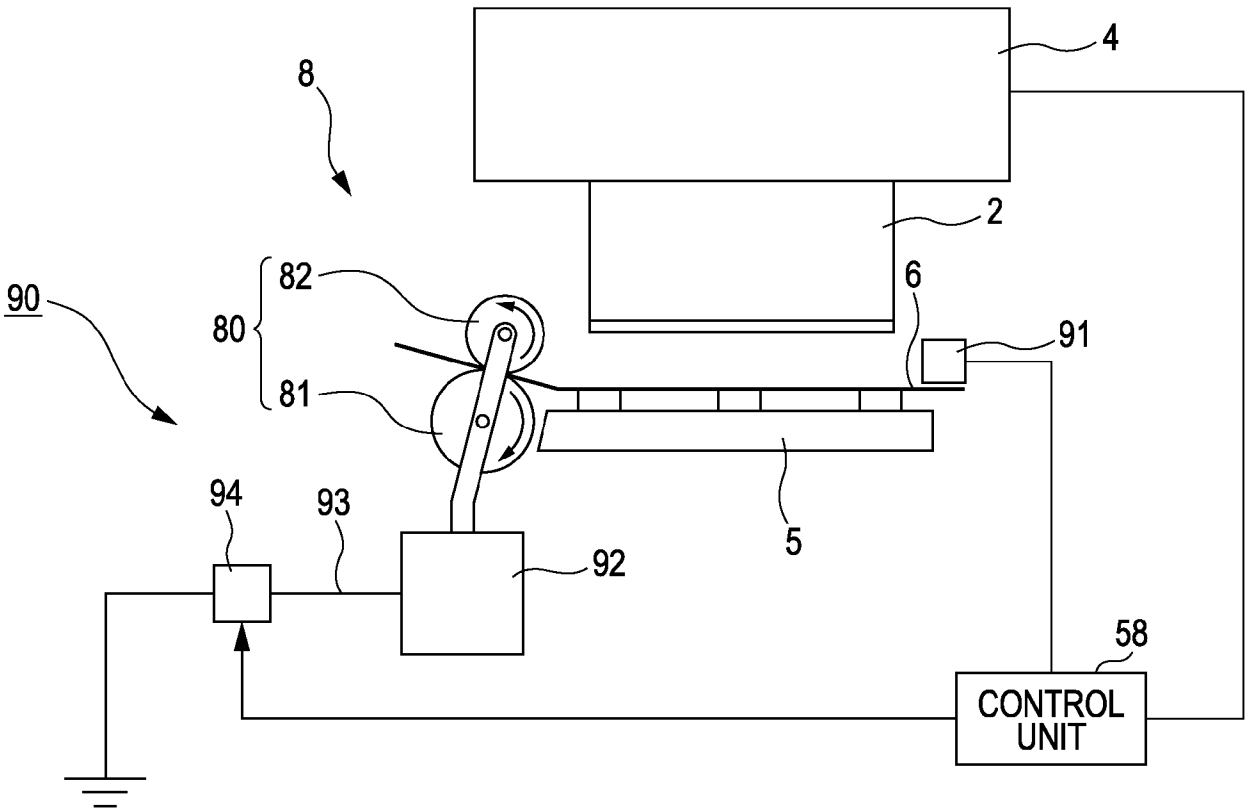
FIG. 3 is a diagram illustrating a cross-section of the side structure of a printer.

FIG. 3 is a diagram illustrating a cross-section of the side structure of the printer 1. As illustrated in FIG. 3, the paper feed mechanism 8 includes a pair of roller portions (contact portions) 80 configured of a primary roller 81 and a slave roller 82 that moves in accordance with the operation of the primary roller 81, and the recording paper 6 is fed onto the platen 5 as a result of the rotation of the primary roller 81 and the slave roller 82.

Incidentally, with the printer 1 configured as described above, when the paper feed mechanism 8 supplies the recording paper 6, the surface of the recording paper 6 is charged due to friction arising as the recording paper 6 rubs against the primary roller 81 and the slave roller 82. When the surface of the recording paper 6 is charged in this manner, paper dust that sticks to the recording paper 6 is also imparted with large charges, and the influence of Coulomb force grows; there is thus a risk of the paper dust being attracted to the nozzles 24 and sticking thereto as foreign objects. This causes a problem in which ink cannot be properly ejected from the nozzles 24.

However, the printer 1 according to this embodiment measures the charge amount of the recording paper 6, as will be described later, and performs a process for decreasing the charge amount of the recording paper 6 when the charge amount has exceeded a predetermined threshold.

To be more specific, the printer 1 according to this embodiment includes a detection sensor (charge amount detection unit) 91 that detects the charge amount of the recording paper 6 and a discharge mechanism 90 for discharging the aforementioned roller portions 80. The detection sensor 91 uses, for example, a static electricity detection sensor.

The discharge mechanism 90 includes a conductive portion 92 that is electrically connected to the primary roller 81 and the slave roller 82, a wiring portion 93 that is connected to the conductive portion 92, and a switching circuit portion 94 provided partway along the wiring portion 93. One end of the wiring portion 93 is grounded. Meanwhile, the control unit 58 is electrically connected to the switching circuit portion 94, and the roller portions 80 can be grounded via the wiring portion 93 by turning the switching circuit portion 94 on or off.

Figure 4:
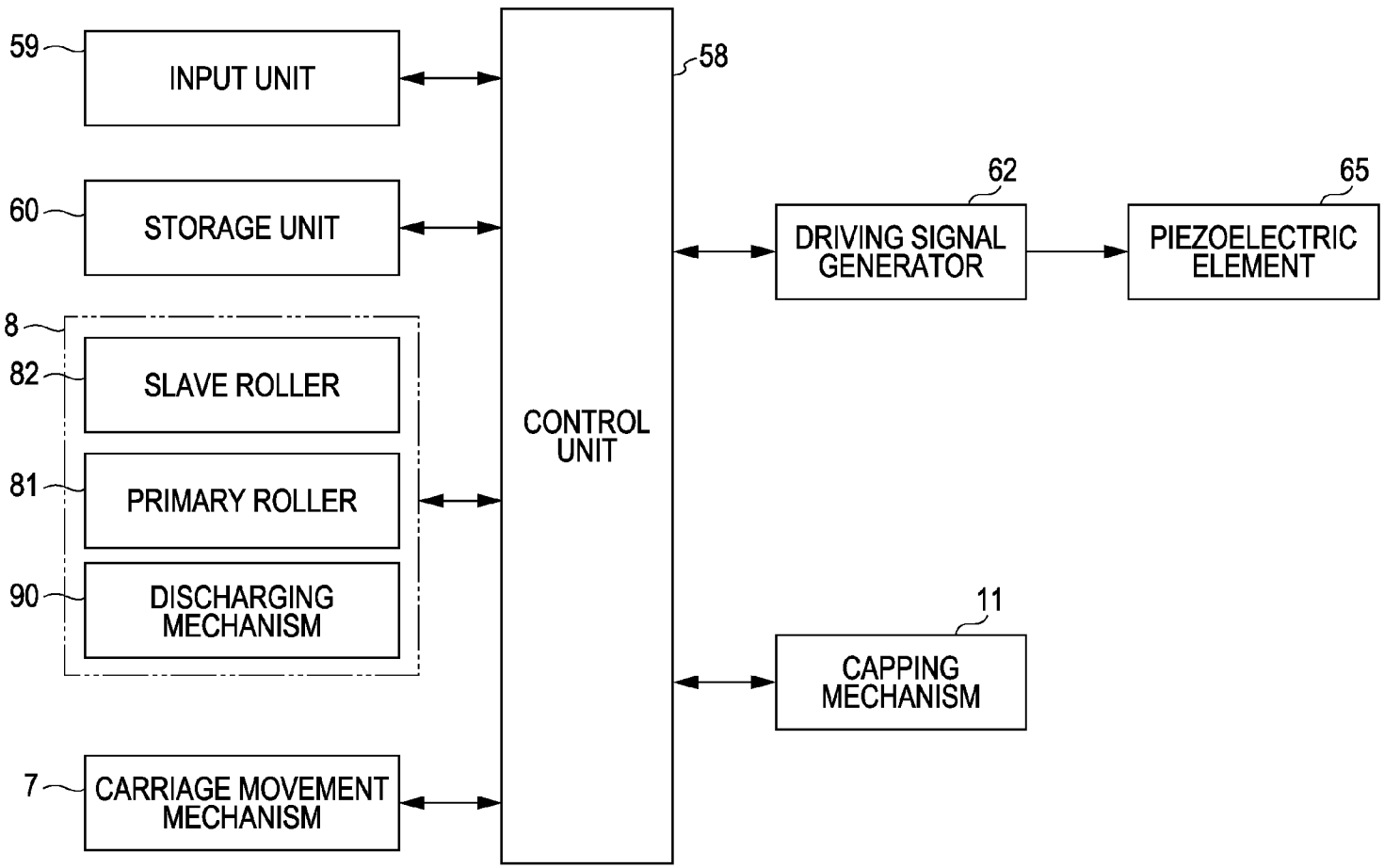
FIG. 4 is a block diagram illustrating the electrical configuration of a printer.

FIG. 4 is a block diagram illustrating the electrical configuration of the aforementioned printer (liquid ejecting apparatus).

The printer 1 includes the control unit 58, which controls the overall operations of the printer 1. An input unit 59 that inputs various types of information related to the operation of the printer 1 and a storage unit 60 that stores various types of information related to the operation of the printer 1 are connected to the control unit 58.

The carriage movement mechanism 7, the paper feed mechanism 8, the capping mechanism 11, and so on are electrically connected to the control unit 58. Furthermore, a driving signal generator 62 that generates driving signals to be inputted into the piezoelectric elements 65 is electrically connected to the control unit 58. Further still, the aforementioned roller portions 80, detection sensor 91, and discharge mechanism 90 are electrically connected to the control unit 58. The printer 1 continuously measures the charge amount of the surface of the recording paper 6 using the detection sensor 91, and communicates the results of the measurements to the control unit 58.

Figure 5:
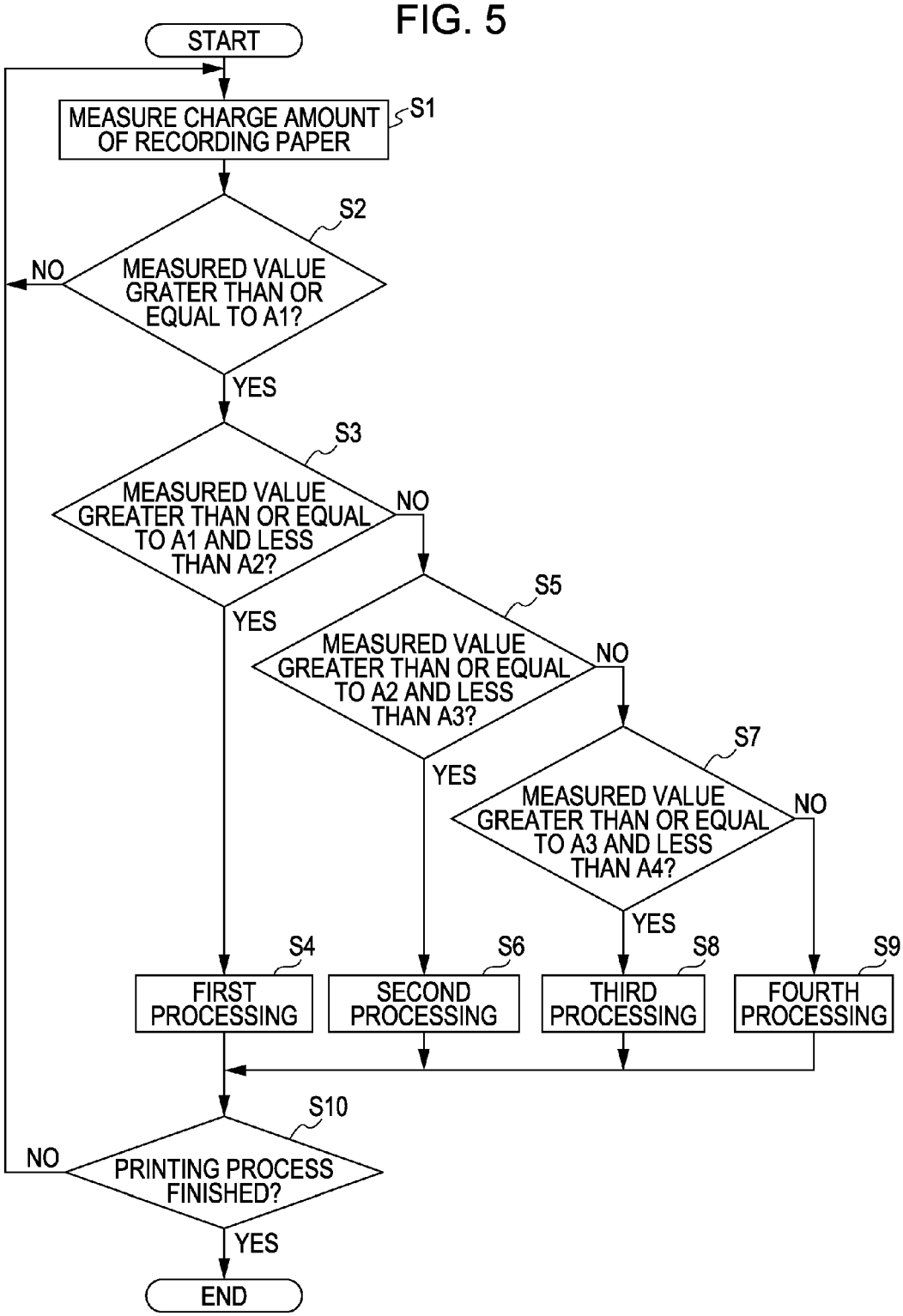
FIG. 5 is a flowchart illustrating operations of a printer.

Next, operations performed by the printer 1 will be described with reference to the flowchart illustrated in FIG. 5. First, the printer 1 drives the paper feed mechanism 8, and ejects into from the nozzles 24 onto the recording paper 6 that has been transported to below the recording head 2. At this time, the detection sensor 91 detects the charge amount of the surface of the recording paper 6 transported by the paper feed mechanism 8 (step S1).

The control unit 58 then compares the result of the measurement performed by the detection sensor 91 with first to fourth thresholds A1 to A4 stored in advance within a memory (step S2). The first threshold A1 is set for, for example, the case where the charge amount is 2 KV. The second to fourth thresholds A2 to A4 are set to charge amounts in 10% increments starting from the first threshold A1. In other words, the fourth threshold A4 is set to a charge amount that is 30% higher than the first threshold A1 (that is, 2.6 KV).

In the case where the value of the charge amount detected by the detection sensor 91 is lower than the first threshold A1, the control unit 58 continues the printing operations performed by the recording head 2 onto the recording paper 6 (step S2).

However, in the case where the value of the charge amount detected by the detection sensor 91 is greater than the first threshold A1, the control unit 58 carries out the following determination (step S2). In the case where it has been determined that the value of the charge amount detected by the detection sensor 91 is greater than the first threshold A1 but is less than the second threshold A2 (that is, greater than or equal to the first threshold A1 and less than the second threshold A2), the control unit 58 performs a first process of controlling the back-and-forth position of the carriage 4, which carries out the printing operation on the recording paper 6, relative to the guide rod 9 (steps S3 and S4).

Normally, in the case where the charge amount of the recording paper 6 is comparatively small as described above, paper dust stuck to the recording paper 6 is prevented from sticking to the ejection surface 23 by the air flow that is produced between the recording head 2 and the recording paper 6 when the carriage 4 moves along the guide rod 9.

Meanwhile, when the carriage 4 that holds the recording head 2 performs printing operations, the carriage 4 moves back and forth along the guide rod 9. When the recording head 2 held in the carriage 4 reaches a return position and temporarily stops, the recording head 2 then moves in the opposite direction. Because the aforementioned air flow is not produced when the recording head 2 has stopped in this manner, there is still a risk that paper dust will stick to the ejection surface 23 due to Coulomb force.

In response to this, the control unit 58 causes the carriage 4 to move back and forth along the guide rod 9 so as to return the recording head 2 at a position in which the nozzles 24 do not cover the end surface of the recording paper 6 when viewed from above. The end surface 6*a* of the recording paper 6 is a cut surface, and thus the amount of paper dust stuck thereto is particularly high; accordingly, there is an extremely high likelihood of paper dust sticking to the nozzles 24.

Figure 6A:
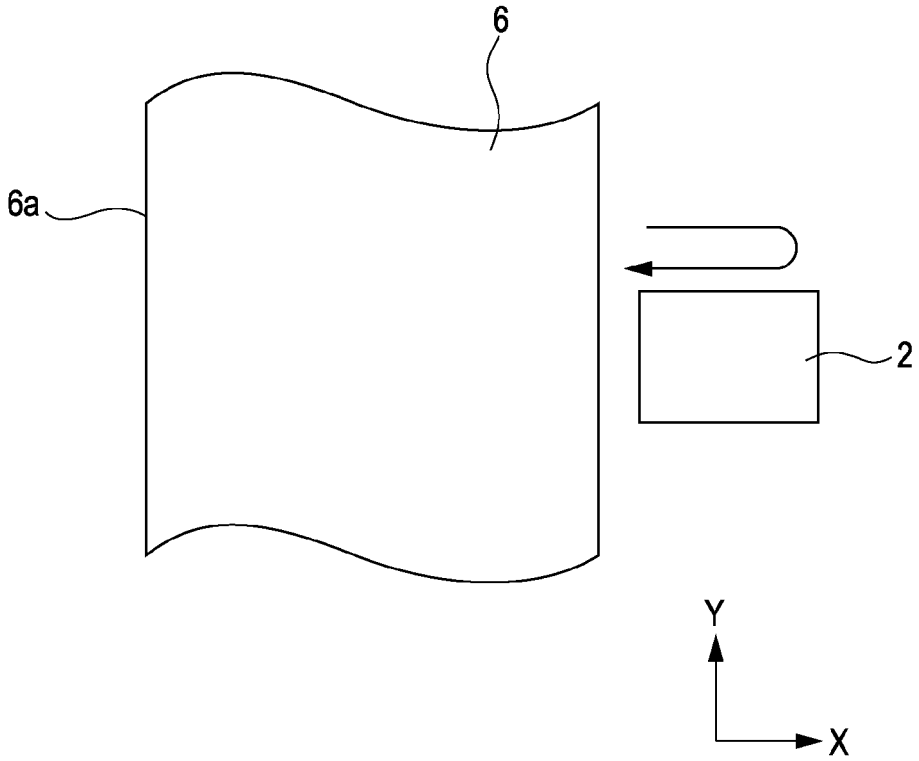
FIGS. 6A and 6B are plan views illustrating the positional relationship between a recording head and recording paper during back-and-forth operation of the recording head.

As shown in FIG. 6A, it is desirable for the control unit 58 to control to return the recording head 2 at a position where the recording head 2 and the recording paper 6 do not overlap when viewed from above. By executing the back-and-forth movement of the recording head 2 at positions where the recording head 2 and the recording paper 6 are completely apart from each other, paper dust can be prevented from sticking to the nozzles 24 even when the recording head 2 has temporarily stopped during the back-and-forth movement.

Figure 6B:
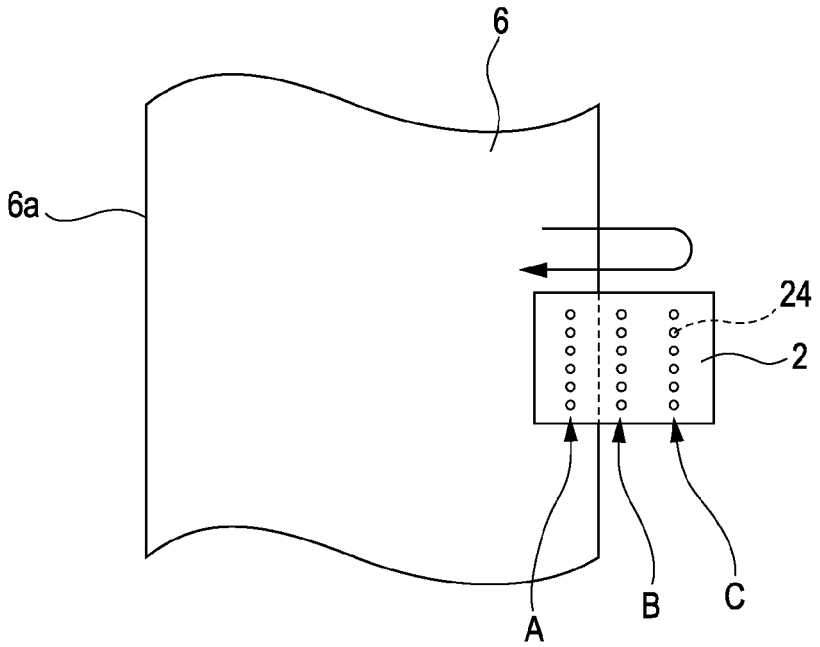

Meanwhile, in the case where, for example, ink is ejected onto a region in part of the recording paper 6, it is not necessary to move the carriage 4 to a position where the recording head 2 does not cover the recording paper 6 when viewed from above. This is because increasing the movement range of the carriage 4 decreases the printing speed. In this case, the carriage 4 is caused to make back-and-forth movement in positions in which the recording head 2 and the recording paper 6 overlap when viewed from above. At this time, as shown in FIG. 6B, the control unit 58 returns the recording head 2 at a position where the nozzles 24 in the nozzle rows A, B, and C formed in the ejection surface 23 do not overlap with the end surface 6*a* of the recording paper 6 (that is, a position where the end surface 6*a* is located between the nozzle rows A, B, and C). According to this configuration, even in the case where the recording head 2 moves back and forth at a position that overlaps with the recording paper 6 when viewed from above, the nozzles 24 do not overlap with the end surface 6*a* of the recording paper 6, where the amount of paper dust that sticks to the recording paper 6 is high, when viewed from above; this makes it possible to prevent paper dust from sticking to the nozzles 24.

As mentioned earlier, when the charge amount of the recording paper 6 as measured by the detection sensor 91 becomes greater than the second threshold A2, it is difficult to sufficiently prevent paper dust from sticking to the nozzles 24 simply by controlling the back-and-forth position of the carriage 4. Accordingly, in the case where the value of the charge amount detected by the detection sensor 91 is greater than the second threshold A2 but less than the third threshold A3 (that is, greater than or equal to the second threshold A2 and less than the third threshold A3), the control unit 58 performs a second process of controlling the paper feed mechanism 8 so that the rotational speed of the primary roller 81 that transports the recording paper 6 becomes relatively slow (steps S5 and S6).

A relatively slower rotational speed of the primary roller 81 refers to reducing the rotational speed of the primary roller 81 that occurred prior to the detection performed by the detection sensor 91. The recording paper 6 is charged mainly due to friction with the primary roller 81. The charge amount of the recording paper 6 increases with the rotational speed of the primary roller 81, eventually reaching a constant value.

In the second process, the control unit 58 reduces the charge amount of the recording paper 6 by reducing the rotational speed of the primary roller 81 by, for example, approximately 10%. Note that the percentage by which the rotational speed is reduced is exemplary, and an appropriate optimum value can be selected depending on the friction coefficient between the primary roller 81 and the recording paper 6 or the like.

Accordingly, the charge amount of the recording paper 6 can be reduced, which in turn makes it possible to reduce the charge amount of the paper dust that sticks to the surface of the recording paper 6. The paper dust can thus be prevented from sticking to the nozzles 24 of the ejection surface 23 due to Coulomb force.

However, when the charge amount of the recording paper 6 as measured by the detection sensor 91 becomes greater than the third threshold A3, it is difficult to sufficiently prevent paper dust from sticking to the nozzles 24 simply by controlling the rotational speed of the primary roller 81 to be relatively lower as described above. Accordingly, in the case where the value of the charge amount detected by the detection sensor 91 is greater than the third threshold A3 but less than the fourth threshold A4 (that is, greater than or equal to the third threshold A3 and less than the fourth threshold A4), the control unit 58 performs a third process of driving the stated discharge mechanism 90 and discharging the primary roller 81 (steps S7 and S8).

Specifically, the control unit 58 turns the switching circuit portion 94 on. As a result, the roller portions 80 are grounded. Accordingly, because the primary roller 81 and the slave roller 82 are grounded, the charge amount of the recording paper 6 is no longer increased. Furthermore, the recording paper 6 that makes contact with the roller portions 80 is discharged through the roller portions 80. Accordingly, the charge amount of the recording paper 6 can be reduced, which in turn makes it possible to reduce the charge amount of the paper dust that sticks to the surface of the recording paper 6. The paper dust can thus be prevented from sticking to the nozzles 24 of the ejection surface 23 due to Coulomb force.

Figure 7:
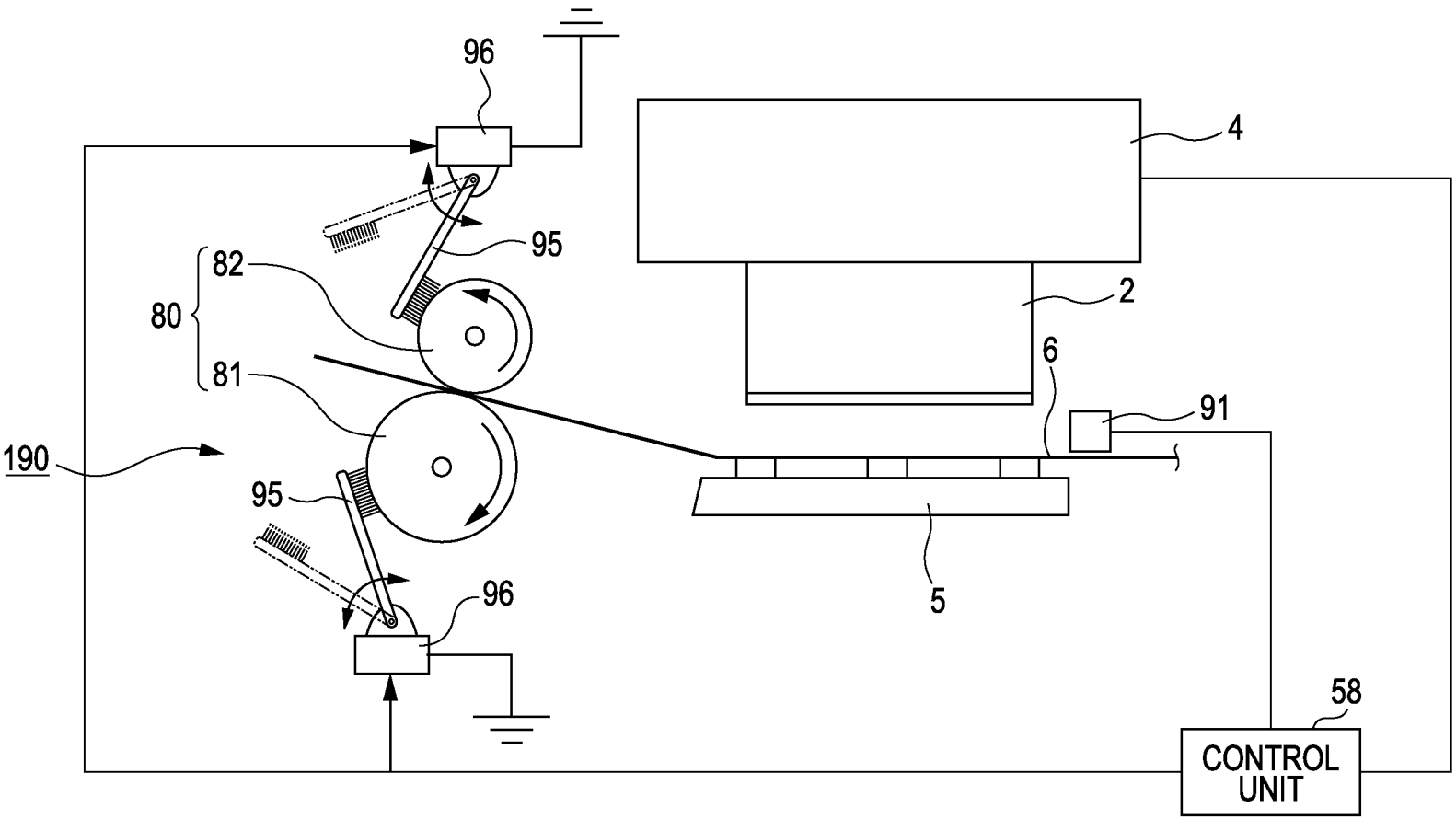
FIG. 7 is a diagram illustrating a configuration according to a variation on a discharging mechanism.

Note that a configuration in which a discharging brush is brought into contact with the roller portions 80 can be employed as the discharge mechanism 90, rather than the mechanism that directly grounds the roller portions 80. FIG. 7 is a diagram illustrating a configuration according to a variation embodying a discharging mechanism 190. As shown in FIG. 7, the discharging mechanism 190 includes a discharging brush (grounding brush) 95 that makes contact with the primary roller 81 and the slave roller 82, and a driving unit 96 that can cause the discharging brush 95 to make contact with and separate from the primary roller 81 and the slave roller 82. The driving unit 96 is electrically connected to the control unit 58, which controls the driving thereof. The discharging brush 95 is configured of a conductive resin material, and is grounded.

When such a discharging mechanism 190 is driven, the control unit 58 drives the driving unit 96, causing the discharging brush 95 to make contact with the roller portions 80. Accordingly, the roller portions 80 can be put into a grounded state; as described above, this discharges the recording paper 6, making it possible to prevent paper dust from sticking to the nozzles 24 of the ejection surface 23 due to Coulomb force.

Meanwhile, if the charge amount of the recording paper 6 exceeds the fourth threshold A4, the likelihood that paper dust sticking to the surface of the recording paper 6 will be pulled toward the nozzles 24 is extremely high. Accordingly, in the case where the charge amount of the recording paper 6 as measured by the detection sensor 91 is greater than the fourth threshold A4, the control unit 58 executes a fourth process of executing the aforementioned first through third processes simultaneously (step S9).

Executing the first through third processes simultaneously in this manner makes it possible to reduce the charge amount of the recording paper 6 with certainty in a short amount of time, which in turn makes it possible to prevent paper dust from sticking to the nozzles 24.

After the first through fourth processes have been carried out, it is determined whether or not the series of printing processes has been completed for the recording paper 6 (step S10). In the case where the printing process has not ended (No), the process returns to step S1, where the control unit 58 compares the charge amount of the recording paper 6 as measured by the detection sensor 91 with the first to fourth thresholds A1 to A4, and performs the aforementioned processing in accordance with the results of the comparison. However, in the case where the printing process has ended (Yes), the control unit 58 stops the operation of the detection sensor 91 and stops the driving of the printer 1.

As described thus far, according to the printer 1 of this embodiment, in the case where the charge amount of the recording paper 6 transported by the paper feed mechanism 8 has exceeded a predetermined value (the first to fourth thresholds), executing the appropriate optimum process from among the first to fourth processes in accordance with the charge amount as described above makes it possible to prevent charged paper dust from sticking to the nozzles 24 as foreign objects.

It is thus possible to prevent ink ejection problems from sticking to the nozzles 24 due to paper dust.

Although the first to fourth processes are executed in accordance with the charge amount of the recording paper 6 in the above embodiment, it is also possible to carry out just one of the processes. Alternatively, two or three of the processes may be carried out as well.

Furthermore, although the above embodiment describes an exemplary case in which the liquid ejecting apparatus is an ink jet printer, the liquid ejecting apparatus is not limited to an ink jet printer, and may be a recording apparatus such as a copier, a facsimile machine, or the like.

Furthermore, although the above embodiment describes an exemplary case in which the liquid ejecting apparatus ejects a liquid such as ink, the invention can also be applied in liquid ejecting apparatuses that eject or discharge a fluid aside from ink. Fluids that can be ejected by the liquid ejecting apparatus include liquids, fluids in which particles of functional materials have been dispersed or dissolved, gel-form fluids, solids that flow like fluids and can be ejected, and other particles (toner or the like).

Furthermore, because the invention gives a solution that can discharge the ejection surface 23 of the recording head 2 as described above, it is also possible to prevent ink ejection problems occurring due to dust, mist produced when the ink is ejected, and so on sticking to the ejection surface 23. Therefore, the invention can also be applied in liquid ejecting apparatuses that eject liquid onto recording media in which paper dust is not produced and the sticking of paper dust is not a problem, such as, for example, a liquid in which materials such as electrode materials, coloring materials, and so on used in the manufacture of films, liquid-crystal displays, EL (electroluminescence) displays, and front emission displays (FEDs) are dispersed (dissolved) throughout a predetermined carrier fluid (carrier).

The entire disclosure of Japanese Patent Application No. 2010-031700, filed Feb. 16, 2010, is expressly incorporated by reference herein.

What is claimed is:

1. A liquid ejecting apparatus comprising:

a transport unit that transports a recording medium;

a liquid ejecting head that ejects a liquid from a nozzle onto the recording medium transported by the transport unit;

a charge amount detection unit that detects a charge amount on the recording medium; and a driving control unit that controls the transport unit so that the transport speed of the recording medium in the case where the charge amount detected by the charge amount detection unit has exceeded a predetermined value becomes slower than the transport speed of the recording medium in the case where the charge amount detected by the charge amount detection unit is smaller than the predetermined value. contact with the recording medium.

2. The liquid ejecting apparatus according to claim 1, further comprising a carriage that holds the liquid ejecting head so that the liquid ejecting head can move back and forth along a guide portion, the driving control unit that causes the carriage to move back and forth along the guide portion so that the liquid ejecting head begins to return at a position in which the nozzle does not overlap with the end surface of the recording medium when viewed from above.

3. The liquid ejecting apparatus according to claim 2, wherein in the case where the carriage is moved back and forth along the guide portion, the driving control unit causes the liquid ejecting head to return at a position in which the liquid ejecting head does not overlap with the recording medium when viewed from above.

4. The liquid ejecting apparatus according to claim 2, wherein the liquid ejecting head includes a nozzle surface having multiple nozzle rows in which multiple nozzles are arranged; and in the case where the carriage is moved back and forth along the guide portion, the driving control unit causes the liquid ejecting head to return when the end surface of the recording medium is positioned between the multiple nozzle rows when viewed from above.

5. The liquid ejecting apparatus according to claim 1, wherein the discharging mechanism has a grounding structure that grounds the contact portion.

6. The liquid ejecting apparatus according to claim 1, further comprising a discharging mechanism that discharges a contact portion of the transport unit that comes into contact with the recording medium, wherein the discharging mechanism includes a grounding brush that is grounded and a driving unit that causes the grounding brush to come into contact with or retract from the contact portion.

7. A liquid ejecting apparatus comprising:

a transport unit that transports a recording medium;

a liquid ejecting head that ejects a liquid from a nozzle onto the recording medium transported by the transport unit;

a carriage that holds the liquid ejecting head so that the liquid ejecting head can move back and forth along a guide portion;

a charge amount detection unit that detects a charge amount on the recording medium; and a driving control unit that, in the case where the charge amount detected by the charge amount detection unit has exceeded a predetermined value, performs the following in progressive stages in accordance with the degree of the charge amount detected by the charge amount detection unit:

controls the transport unit so that the transport speed of the recording medium becomes relatively slower;

causes the carriage to move back and forth along the guide portion so that the liquid ejecting head begins to return at a position in which the nozzle does not overlap with the end surface of the recording medium when viewed from above; and drives a discharging mechanism that discharges a contact portion of the transport unit that comes into contact with the recording medium.

8. The liquid ejecting apparatus according to claim 1, wherein the recording medium is paper.

* * * * *